US005850755A

United States Patent [19]

Segal

[11] Patent Number: 5,850,755

[45] Date of Patent: Dec. 22, 1998

[54] METHOD AND APPARATUS FOR INTENSIVE PLASTIC DEFORMATION OF FLAT BILLETS

[76] Inventor: Vladimir M. Segal, 1831-A Wild Oak Cir., Bryan, Tex. 77802

[21] Appl. No.: 385,334

[22] Filed: Feb. 8, 1995

[51] Int. Cl.[6] ..... B21C 23/02

[52] U.S. Cl. ..... 72/261

[58] Field of Search ..... 72/261

[56] References Cited

U.S. PATENT DOCUMENTS

| | | | |
|---|---|---|---|
| 1,370,328 | 3/1921 | Lowe | 72/261 |
| 3,954,514 | 5/1976 | Webster et al. . | |
| 4,092,181 | 5/1978 | Paton et al. . | |
| 4,386,513 | 6/1983 | Doudet | 72/261 |
| 4,511,409 | 4/1985 | Ferton et al. . | |
| 4,721,537 | 1/1988 | Ghosh . | |
| 4,722,754 | 2/1988 | Ghosh et al. . | |
| 4,722,755 | 2/1988 | Maehara . | |
| 5,087,297 | 2/1992 | Pouliquen . | |
| 5,122,196 | 6/1992 | Fernandez . | |
| 5,160,338 | 11/1992 | Legresy et al. . | |

FOREIGN PATENT DOCUMENTS

| | | |
|---|---|---|
| 575892 | 10/1974 | U.S.S.R. . |
| 492780 | 11/1975 | U.S.S.R. . |
| 515968 | 5/1976 | U.S.S.R. . |
| 541877 | 1/1977 | U.S.S.R. . |
| 780293 | 3/1978 | U.S.S.R. . |
| 804049 | 2/1981 | U.S.S.R. . |
| 812401 | 3/1981 | U.S.S.R. . |
| 902884 | 2/1982 | U.S.S.R. . |
| 902962 | 2/1982 | U.S.S.R. . |
| 1140870 | 2/1985 | U.S.S.R. . |

OTHER PUBLICATIONS

Wert et al., "Grain Refinement in 7075 Aluminum by Thermo–Mechanical Processing", Matallurgical Transactions vol. 12A (Jul. 1981), pp. 1267–1276.

Grimes and Butler, "The Properties and Applications of Currently Exploited Superplastic Aluminum Alloys", Superplasticity in Advanced Materials, 1991; p. 771.

Roija and Graham, "AL–Li Alloys Find Their Niche", Advanced Materials & Processes, Jun. 1992, p. 23.

Wittenauer et al., "Tungsten and Its Alloys," Advanced Materials & Processes, Sep. 1992, p. 28.

Bouchard et al., "Monte Carlo simulations of textured planar magnetron targets", J. Vac. Sci. Technol. A, 11(15), Sep/Oct. 1993, p. 2765.

Segal, Vladimir M., "Working of Metals by Simply Shear Deformation Process" Proceedings: 5th International Aluminum Extrusion Technology Seminar, 1992.

Segal, Vladimir M., "Simple Shear as a Metalworking Process for Advanced Materials Technology", First International Conference on Processing Materials for Properties, Nov. 1993.

Gregory, John C. Letter from Overseas Strategic Consulting, Ltd. to David W. Brownlee, Esq., "Metals Forging Technology Available for License", Nov. 12, 1993.

*Primary Examiner*—Lowell A. Larson
*Attorney, Agent, or Firm*—I. Zborovsky

[57] ABSTRACT

Methods and apparatus are described for the plastic deformation of flat rectangular billets. Simultaneous extrusion of two flat rectangular billets through a die having channels of equal cross-sectional area alters billet material structure, texture, and physicomechanical properties without altering billet dimensions. The extrusion system of the present invention prolongs die lifetime, increases punch stability, decreases punch working load and pressure requirements, eliminates the difficulties associated with lubricating movable parts of the die under high pressure and temperature, optimizes use of press space, and provides for automatic and independent ejection of extruded billets from the die. The methods of plastic deformation processing of flat rectangular billets in the present invention allow for the production of a variety of structural, textural, and physicomechanical properties previously unobtainable for large flat rectangular billets.

4 Claims, 6 Drawing Sheets

METHOD AND APPARATUS FOR INTENSIVE PLASTIC DEFORMATION OF FLAT BILLETS

TECHNICAL FIELD OF THE INVENTION

The present invention relates to the plastic deformation of flat billets. More specifically, the present invention relates to methods and apparatus for intensive plastic deformation of flat billets to control material structure, texture, and physicomechanical properties by mechanical and thermomechanical treatment.

BACKGROUND OF THE INVENTION

An effective way to improve physicomechanical properties of materials is to control their structure and texture. Thermomechanical processing (i.e., various combinations of heat treatment and mechanical working) is performed on materials to refine grains and phases, change their aspect ratios, orientation and distribution, and develop substructures. Intensive plastic deformation plays an important role in thermomechanical materials processing. Different deformation methods are used for material processing depending upon the shape and dimensions of the billet and the initial and final properties of the material.

Traditionally, forming operations such as forging and rolling were performed on billets to develop desired physicomechanical properties. However, in many respects, such operations are ineffective. The difficulty in achieving the high strains necessary for structure and texture formation represents the greatest limitation in these operations. In order to develop cumulative strain sufficient to provide grain refinement by recrystallization during subsequent annealing, it is necessary to apply a number of successive forging stages along the three perpendicular axes of a billet (see, e.g., U.S. Pat. Nos. 3,954,514 and 4,721,537). However, such a forging operation may be used only with billets having approximately equal dimensions along their three perpendicular axes. The treatment of plates by such a process results in a marked change of billet dimensions from a plate to a bar-shape (see, e.g., U.S. Pat. No. 4,511,409).

In addition to structural requirements, certain texture formation may be desired. To develop strong texture (e.g., <110>) in aluminum sputtering targets, upsetting forging should be performed unidirectionally (see, e.g., U.S. Pat. Nos. 5,087,297 and 5,160,388). Because sputtering targets are thin discs having diameters up to 350 mm, upsetting forging is a difficult operation and requires the use of powerful presses and expensive tools. In addition, the maximum true strain which is practically achievable is less than 1.6 (i.e., compressive strain of approximately 80%). Therefore, the fine grain structure desirable for uniform sputtering and high quality films is not achievable with this method (see Bouchard, F. et al., *Journal of Vacuum Science and Technology*, (1993) 411(5):2765–2770). Moreover, upsetting forging of aluminum sputtering targets results in non-uniformity of strain and other properties which reduce the quality of the target.

Working materials by rolling operations presents similar problems. For example, to develop fine grain structure and of aluminum alloy 7475, the material should be rolled at low temperatures with true strains exceeding 2.3 (see Wert, J. A. et al., *Metallurgical Transactions*, (1981) 12A:1267–1276 and U.S. Pat. Nos. 4,722,754, 5,222,196, and 4,092,181). From a practical standpoint, such processing may be realized only for plates having an original thickness less than 40–50 mm. Therefore, the high quality final product is currently available only as sheets having thicknesses less than 3 mm (see Grimes, R. et al., *Superplasticity in Advanced Materials*, (1991) eds. Hori, S. et al. 771–776).

Similarly, the development of different textures and anisotropic properties by rolling is difficult. Desired plane textures and enhanced properties can be created only along the rolling direction with accompanying large reductions (see e.g., U.S. Pat. Nos. 3,954,516, 4,406,715, 4,609,408, 4,753,692 and 5,079,907). In addition, methods are not available which develop the required texture and anisotropy at a desired angle relative to the rolling direction at the rolling plane. Production of non-oriented textureless or isotropic products by rolling is also a difficult problem. Moreover, intensive rolling develops strongly laminated materials that often exhibit anisotropy of material properties which cannot be eliminated through existing technologies. (see Rioja, R. J. et al., *Advanced Materials and Processes*, (1992) 141(6):23–26).

To overcome some of the limitations of traditional methods of materials processing, another method known as equal channel angular extrusion has been used. (see, Invention Certificate of the USSR No. 575892; Segal, V. Working of Metals By Simple Shear Deformation Process, *In Proceedings V International Aluminum Extrusion Technology Seminar*, (1992) 403–406; Segal,V., Simple Shear As a Metal Working Process For Advanced Materials Technology, *In First International Conference on Processing Materials For Properties*, eds. Henenin, H. et al., (1993) 947–950). In this method, a billet is extruded through meeting channels of the same cross-sectional area. The cross-sectional area of the channels is identical to that of the original billet. This process is illustrated in FIGS. 1A–D. A well-lubricated billet 20 of square or round cross-section is inserted into a first channel 22 of a die 24 along a longitudinal axis of the billet (see FIG. 1A). Punch 26 causes the billet 20 to be extruded from the first channel 22 into a second channel 28 (see FIGS. 1B and 1C). Following extrusion into the second channel 28, the punch 26 returns to its original position and the worked billet 20 may be withdrawn from the die 24 (see FIG. 1D).

Plastic deformation of the billet is achieved by simple shear along the crossing plane of the intersecting first and second channels 22, 28 (See FIG. 1B). In this manner, the entire billet 20, except for the small end portions, is uniformly worked under low pressure and low load without any change in the original cross-sectional area. The amount of true strain produced may be altered by varying the angle ($2\Theta$) between the first and the second channel 22, 28. For example, where $2\Theta=90°$, true strain following extrusion is approximately 1.15, which corresponds to a uniform area reduction of approximately 70%. Because billet dimensions are not changed, the operation can be repeated numerous times to create very high levels of cumulative true strain. In addition, a variety of grain structures and textures may be developed by rotation of the billet about the longitudinal axes of the billet and/or by altering the direction of successive extrusions. In this way, many extraordinary effects of intensive plastic deformation on material structure and properties may be explored in bulk products which formerly could only be realized for thin wire and foil. However, the known method and apparatus for equal channel angular extrusion are not without limitations. More particularly, the application of the known method and apparatus to flat billets is problematic. First, oriented grain structures and textures along any desired direction at the flat surface of the billet and heavily wrought textureless materials can not be developed in final products having small thickness and large width and length. Second, during extrusion high levels of friction reduce die lifetime and increase press capacity requirements. Third, the dimensions of the die must be great due to the unopposed lateral forces and friction produced during extrusion. Fourth, insertion of billets into and withdrawal of billets from dies is difficult at standard presses.

SUMMARY OF THE INVENTION

One embodiment of the present invention provides an extrusion apparatus for deformation processing of flat rectangular billets. The apparatus includes a first and a second vertical channel having cross-sections corresponding to a cross-section of the billets. The apparatus further includes a first and a second horizontal channel having cross-sections corresponding to the cross-section of the billets and being contiguous with and oriented at an angle relative to the first and the second vertical channels, respectively. An actuator is arranged to extrude the billets from the first and the second vertical channels into the first and the second horizontal channels, respectively.

Another embodiment of the present invention provides an extrusion system for deformation processing of flat rectangular billets having given dimensions of length and width. The extrusion system includes a first extrusion apparatus arranged to extrude the billets along the length of the billets and a second extrusion apparatus arranged to extrude the billets along the width of the billets.

Another embodiment of the present invention is a method of deformation processing of flat rectangular billets. The method includes the steps of inserting a billet into each of a first and a second vertical channel having cross-sections corresponding to the cross-section of the billets, extruding the billets from the first and the second vertical channel into a first and a second horizontal channel, respectively, the first and the second horizontal channel having cross-sections corresponding to the cross-section of the billets and being contiguous with and oriented at an angle relative to the first and the second vertical channel, respectively, and repeating the steps of inserting and extruding the billets.

Another embodiment of the present invention provides a product prepared by a method of deformation processing of flat rectangular billets. The method includes the steps of inserting a billet into each of a first and a second vertical channel having cross-sections corresponding to a cross-section of the billets and extruding the billets from the first and the second vertical channel into a first and a second horizontal channel, respectively, the first and the second horizontal channel having cross-sections corresponding to the cross-section of the billets and being contiguous with and oriented at an angle relative to the first and the second vertical channel, respectively.

Another embodiment of the present invention is a method of deformation processing of flat rectangular billets. The method includes the steps of inserting a billet into a vertical channel having a cross-section which corresponds to a cross-section of the billet, extruding the billet from the vertical channel into a horizontal channel having a cross-section corresponding to the cross-section of the billet and being contiguous with and oriented at an angle relative to the vertical channel and repeating the steps of inserting and extruding the billet.

Another embodiment of the present invention provides a product prepared by a method of deformation processing of flat rectangular billets. The method includes the steps of inserting a billet into a vertical channel having a cross-section corresponding to a cross-section of the billet, extruding the billet from the vertical channel into a horizontal channel having a cross-section corresponding to the cross-section of the billet and being contiguous with and oriented at an angle relative to the vertical channel and repeating the steps of inserting and extruding the billet.

BRIEF DESCRIPTION OF THE DRAWINGS

For a more complete understanding of the present invention and the advantages thereof, reference is now made to the following descriptions taken in conjunction with the accompanying drawings in which:

FIGS. 1A–D show a known processing method for equal channel angular extrusion of elongated billets.

FIG. 13 shows a method of plastic deformation processing to produce wrought equiform structures and full textures along the shear plane and the shear direction.

FIGS. 14A–D show a method of plastic deformation processing by equal channel angular extrusion and post-extrusion rolling to produce wrought structures with controlled texture and anisotropy in flat products of large width and length.

DESCRIPTION OF THE PREFERRED EMBODIMENTS

Preferred embodiments of the invention will now be described with reference to the accompanying figures.

The present invention includes methods and apparatus for the plastic deformation of flat rectangular billets. Simultaneous extrusion of two flat rectangular billets through a die having channels of equal cross-sectional area alters billet material structure, texture, and physicomechanical properties without altering billet dimensions. The extrusion system of the present invention prolongs die lifetime, increases punch stability, decreases punch working load and pressure requirements, eliminates the difficulties associated with lubricating movable parts of the die under high pressure and temperature, optimizes use of press space, and provides for automatic and independent ejection of extruded billets from the die. The methods of plastic deformation processing of flat rectangular billets in the present invention allow for the production of a variety of structural, textural, and physico-mechanical properties previously unobtainable for large flat rectangular billets.

Figure 1A:
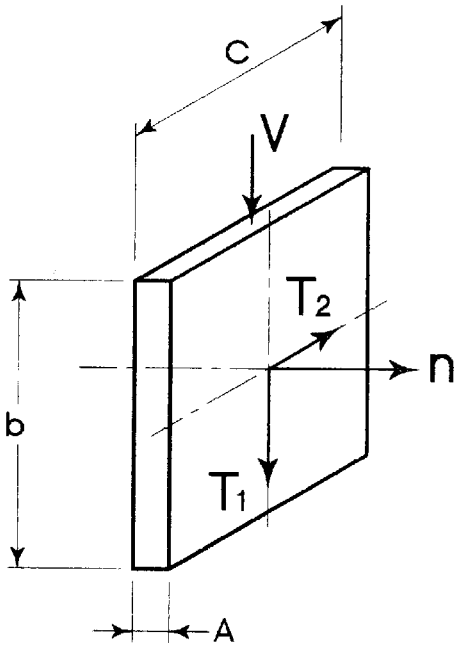
Figure 1B:
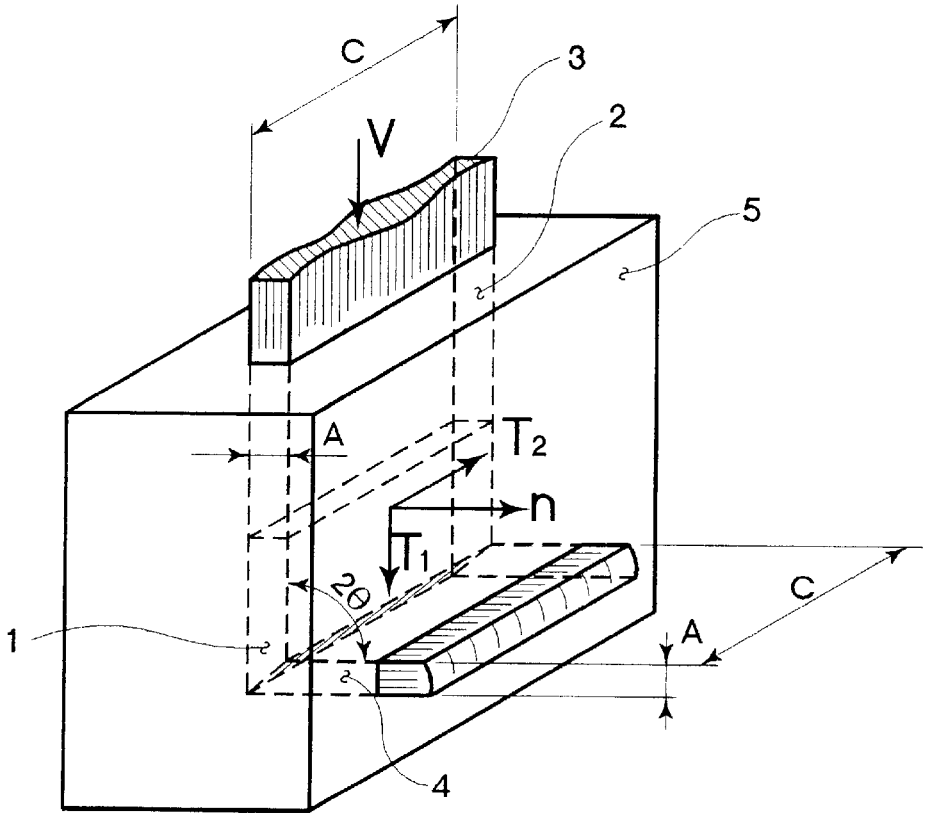
Figure 2A:
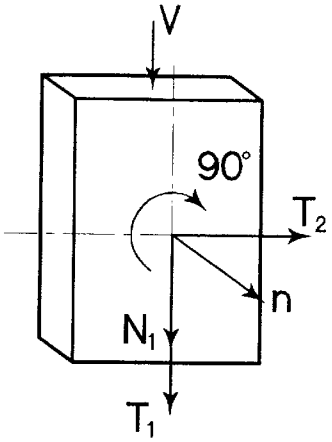
FIG. 2A shows a convention for the axes and dimensions of a flat rectangular billet.

To aid in the understanding of the methods and apparatus of the present invention a convention for the axes and dimensions of a rectangular flat billet is shown in FIG. 2A. The longitudinal axes are designated $T_1$ and $T_2$, respectively, and the perpendicular axis to the billet flat surface is designated n. The dimensions of the billet along axes $T_1$, $T_2$ and n are designated b (length), c (width) and A (thickness), respectively. The extrusion direction is designated V.

Figure 2B:
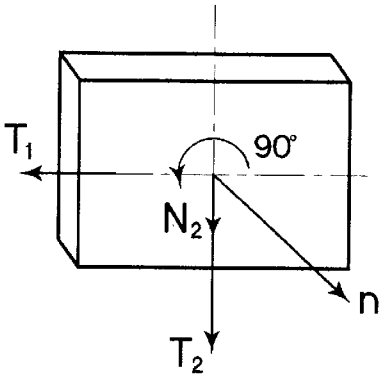
FIG. 2B is a three dimensional depiction of an apparatus for equal channel angular extrusion of flat rectangular billets.
Figure 2C:
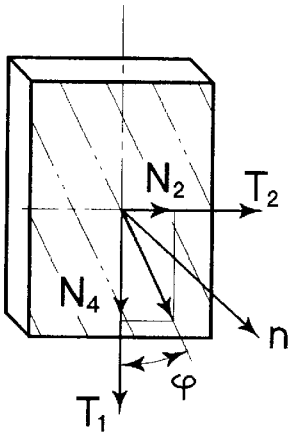

In addition, a simplified depiction of the extrusion of a flat rectangular billet with reference to the axes and dimensions of FIG. 2A is shown in FIG. 2B. The billet 20 is extruded along axis $T_1$ in direction V within the vertical channel 22 by the punch 26. Simple shear is produced along axis $T_1$ at the crossing plane of the intersecting vertical and horizontal channels 22, 28. The amount of the strain produced is dependent upon the angle (2Θ) between the vertical and horizontal channels 22, 28 and the number and orientation of extrusions performed. Material structure, texture and physicomechanical properties of the billet 20 are altered without altering billet dimensions (b, c, and A). For the purposes of this application the term billet will be understood to include, but is not limited to, the products, both semi-finished and finished, resulting from the processing of a billet by equal channel angular extrusion.

Referring to FIGS. 3–6, the extrusion system of the present invention includes a die 30 for realizing deformation processing of flat rectangular billets. The die 30 of the extrusion system comprises two side plates 32 rigidly connected perpendicular to a base plate 48. Two rest plates 38 are rigidly connected to the base plate 48 and to the side plates 32 such that the rest plates 38 and the side plates 32 form a rectangular wall extending upward from the base plate 48. Two front plates 36 are rigidly connected on top of the rest plates 38 and between the side plates 32. Four blocks 46 are interposed between the connection of the front 36 and rest plates 38 such that two horizontal channels 60 are produced between the front 36 and the rest plates 38 on opposite sides of the die 32. The horizontal channels 60 have dimensions equivalent to those of the billet. The front plates 36, the blocks 46, and the rest plates 38 are rigidly connected to one another by front plate bolts 44 which are inserted through the front plates 36, the blocks 46 and the rest plates 38. The side plates 32 are rigidly connected to the front plates 36 by side plate bolts 42 which are inserted through the side plates 32 into the front plate lugs 40.

A movable slider 50 is positioned between the side plates 32, the front plates 36, and the rest plates 38. The movable slider 50 has two longitudinal cavities 54 which are oriented toward the front plates 36 and the rest plates 38. The longitudinal cavities 54 combine with a protrusion 56 on each of the rest plates 38 to create a pair of vertical channels 58 on opposite sides of the die 30 so that billets can be introduced into the die 30. The vertical channels 58 are contiguous with and oriented at an angle relative to the horizontal channels 60. The vertical and horizontal channels 58, 60 have dimensions equivalent to those of the billet.

Figure 3:
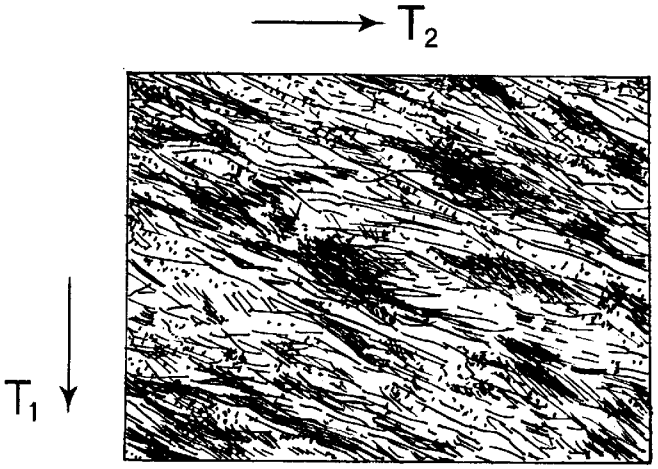
FIG. 3 is a cross sectional view of an extrusion apparatus in accordance with an embodiment of the invention.
Figure 4A:
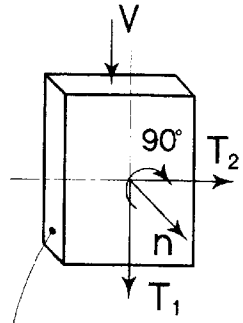
FIG. 4 is a cross sectional view of section IV—IV of FIG. 3.
Figure 5A:
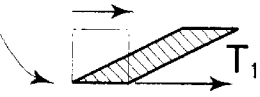
FIG. 5 is a side view of the extrusion apparatus of FIG. 3 taken in the direction of V.
Figure 4B:
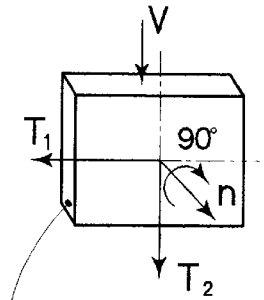
Figure 5B:
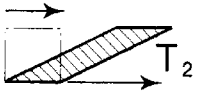
Figure 4C:
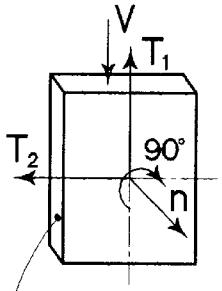
Figure 5C:
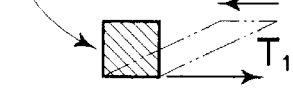
Figure 4D:
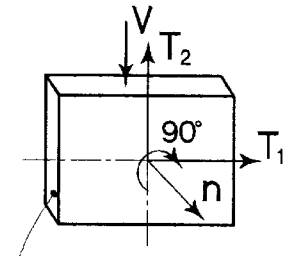
Figure 5D:
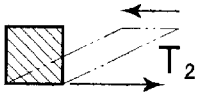

The extrusion apparatus also includes a press 34 for extruding the billet through the die 30 (see FIGS. 3 and 5). The press includes a punch 62 having one T-shaped end 64 and having a T-shaped slot 66 on the opposite end. A bolster plate 70 having punch guides 68 allows the T-shaped end of the punch 64 to be adjustably attached to the press 34. An air cylinder 72 is connected to the bolster plate 70 such that the punch 62 may be moved from a first loading position (see FIG. 5, left side of drawing) to a second operating position (see FIG. 5, right side of drawing). An adjustable stop 74 is mounted opposite the air cylinder 72 to provide accurate placement of the punch in the operating position. A limit switch 76 is mounted opposite the power cylinder 72 to prevent the press 34 from being operated prior to placement of the punch 62 in the operating position.

Figure 6:
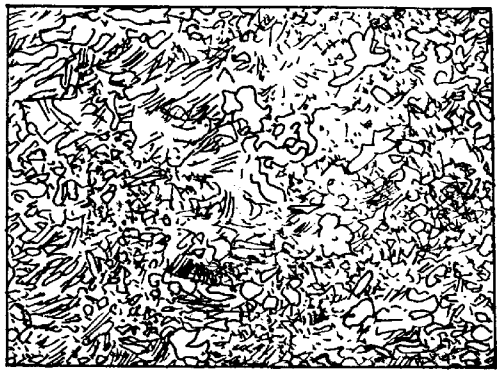
FIG. 6 is an enlarged view of the area of VI of FIG. 3.
Figure 7A:
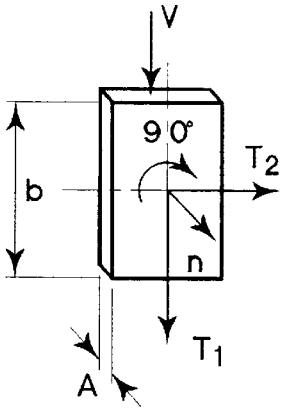
FIG. 7 is an enlarged view of the area of VII of FIG. 5.
Figure 7B:
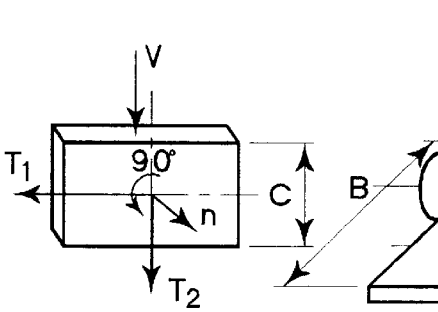
Figure 7C:
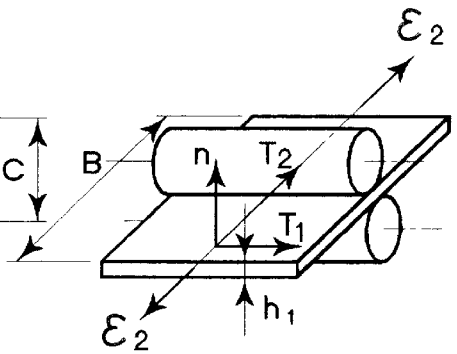
Figure 7D:
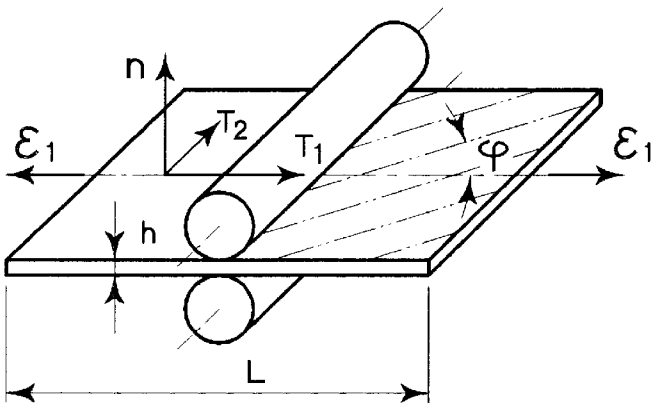

The movable slider 50 and the punch 62 are connected by interaction of the T-slot 66 of the punch 62 and the T-shaped head 52 of the movable slider 50 (see FIG. 3). A two-sided wedge 80 is connected to the bottom of the movable slider 50. The two-sided wedge 80 is broadest at its bottom and has two inclined faces 82 which are adjacent the rest plates 38 (see FIG. 6 showing one side of the two-sided wedge). The two-sided wedge 80 also has two inclined slots 88 which are adjacent one of the side plates 32. The movable slider 50 controls the movement of two pushers 78 by the interaction of the two-sided wedge 80 with the pushers 78. Each of the two pushers 78 have an inclined shoulder 86 and an inclined surface 84. The inclined shoulder 86 of each pusher 78 extends into the inclined slot 88 of one side of the two-sided wedge 80. The inclined surface 84 of each pusher 78 contacts the inclined face 82 of one side of the two-sided wedge 80. Each pusher 78 has a guide 92 protruding from a surface adjacent one of the side plates 32 and an ejector 90 protruding from a surface adjacent the rest plate 38. The pusher guide 92 projects into a vertical guide slot 96 in the side plate 32. The vertical guide slot 96 is contiguous with a horizontal guide slot 94 in the side plate 32. The vertical guide slot 96 terminates at its top in the horizontal guide slot 94 which extends toward the horizontal channel 60 of the die 30.

When the press 34 is operated (see FIGS. 3 and 6), the movable slider 50 containing a billet enters the die 30 and the inclined slots 88 of the two-sided wedge 80 act on the pushers 78 to move them along the horizontal guide slot 92 into the vertical guide slot 96. The pushers 78 then move downward in the vertical guide slots 96 as the punch 62 and the movable slider 50 extrude a billet into the horizontal channel 60. Upon reaching the bottom position (FIG. 3, right side of drawing), the punch 62, the movable slider 50, the two-sided wedge 80, and the pushers 78 are retracted (FIG. 3, left side of drawing). When the pusher guides 92 reach the horizontal guide slots 94, the inclined slots 88 of the two-sided wedge 80 act on the inclined shoulder 86 of the pushers 78 to advance the ejectors 90 into the horizontal channels 60 to eject the extruded billets (see FIGS. 3 and 6).

Following ejection, the billets contact two pairs of profiled rolls 100 driven by a motor 102 via a reducer 104. The roll 100 axes are oriented vertically and their longitudinal midpoints correspond to the longitudinal midpoints of the horizontal channels 60 (see FIGS. 3–5). The rolls 100 reduce slightly the dimension of the billet (c) along longitudinal axis $T_2$ when the billet is extruded along axis $T_1$ (see FIG. 7; where indications of billet dimensions are those depicted in FIG. 2A). Alternatively, when the billet is extruded along axis $T_2$ (not shown), the dimension of the billet (b) is reduced slightly along axis $T_1$. The total reduction in billet dimension (Δ; approximately one to two millimeters) is the sum of the reduction in dimension at each lateral end of the billet (Δ/2; see FIG. 7 where the dotted line represents the original billet shape and the solid line represents the final billet shape). In addition, operation of the rolls produces radii 98 at each lateral end of the billet. To reduce slipping, the peripheral speed of the rolls 100 corresponds to the speed of extrusion. Operation of the rolls 100 is necessary to insert the billets into the channels for subsequent extrusion and to eliminate barbs created by extrusion.

The extrusion system of the present invention further includes a pair of dies 30 for deformation processing of flat rectangular billets having unequal dimensions along a first and a second longitudinal axis (see FIG. 2A). To provide for extrusion along both longitudinal axes, the dimensions of the vertical and horizontal channels 58, 60 of the first die 30 will be equivalent to those of the billet in a first orientation and the vertical and horizontal channels 58, 60 of the second die 30 will have dimensions equivalent to those of the billet in a second orientation (i.e., rotated 900 about the normal axis (n) to the flat surface of the billet; see, e.g., FIG. 8A–C).

The die 30 of the present extrusion system is preferably fabricated from tool grade steel. Alternatively, the die 30 may be fabricated from ordinary structural steel with tool grade steel inserts coupled to all surfaces of the die which contact the billets (i.e., the vertical channels 58, the horizontal channels 60, and the moveable slider 50). This alternative die design reduces the time and expense required to replace worn out die components and allows the die to be adaptable to billets of varying dimensions.

A method of plastically deforming flat rectangular billets includes the insertion a billet into each of the longitudinal cavities 54 of the movable slider 80. The extrusion of each billet from the vertical channels 58 into the horizontal channels 60 is accomplished by operation of the press 34. Following extrusion, the billets are ejected from the horizontal channels 60 by the interaction of the two-sided wedge 80 and the pushers 78. Following ejection, billets are rolled by the profiled rolls 100 driven by motor 102 via the reducer 104. Rolling facilitates multipass equal channel angular extrusion by reducing slightly billet width and eliminating barbs created by extrusion. Plastic deformation processing of flat billets by this method alters the material structure, texture, and physicomechanical properties of the billets without altering significantly their dimensions. In addition, this process can be applied at cold, warm or hot working conditions to a variety of materials including metals, alloys, composites, ceramics, polymers and the like.

Plastic deformation processing of billets by multiple pass equal channel angular extrusion includes the use of a convention for the axes and dimensions of the billet (see FIG. 2A). Three mutually perpendicular directions in the billet are designated $T_1$ (along one longitudinal axis), $T_2$ (along another longitudinal axis) and n (along the axis perpendicular to the billet flat surface). The dimensions of the billet along axes $T_1$, $T_2$ and n are designated A (thickness), b (length) and c (width), respectively. The extrusion direction is designated V. According to the present invention, there are several multiple pass extrusion methods for processing flat billets.

Figure 8:
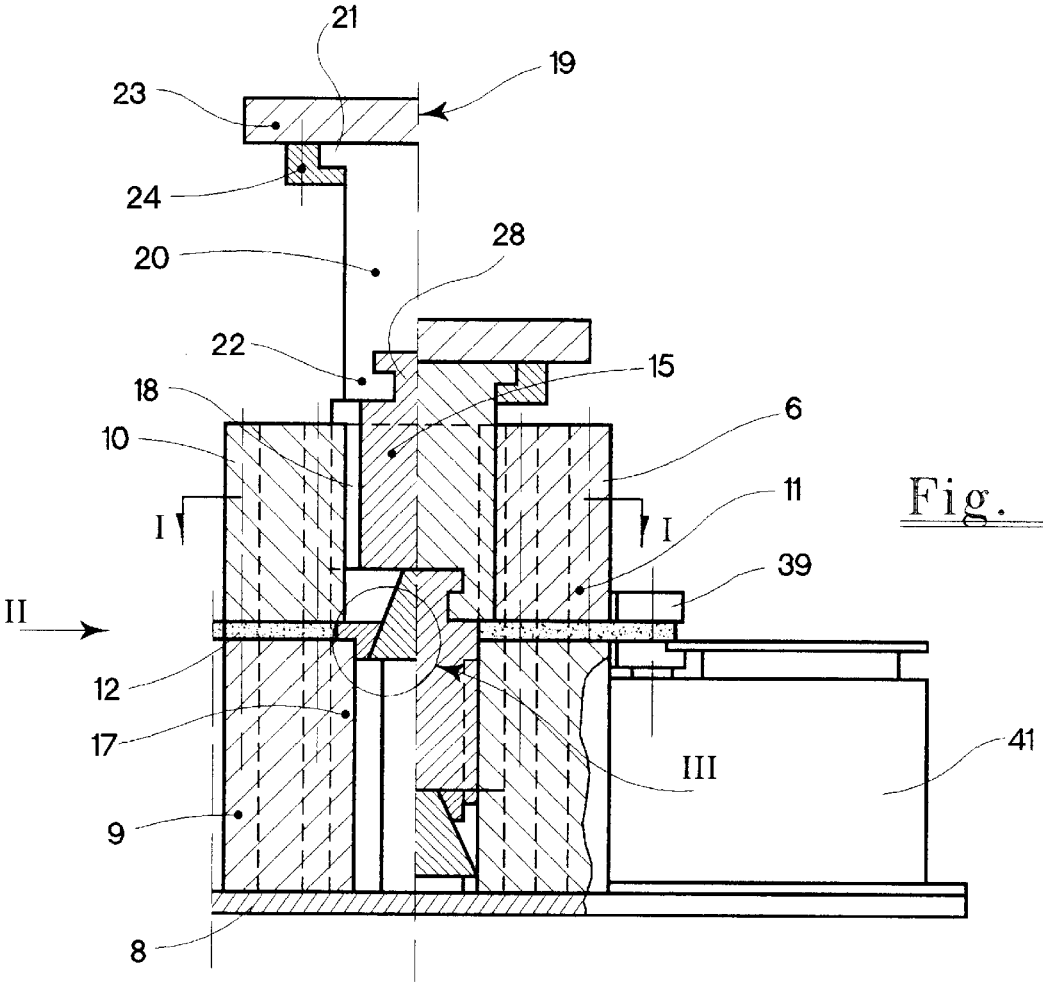
FIGS. 8A–C show a method of plastic deformation processing to produce rolling-like textures and elongated structures oriented into the prescribed direction at the flat surface of the billet.

Referring to FIGS. 8A–C, extrusion is performed with a number of passes ($N_1$) along axis ($T_1$) (see FIG. 8A) and with number of passes ($N_2$) along axis ($T_2$) (see FIG. 8B) in any sequence. The extrusion direction is periodically changed from one longitudinal axis ($T_1$) to the other longitudinal axis ($T_2$) by alternately rotating the billet 90° in a clockwise and a counter-clockwise direction about the perpendicular axis (n) to the billet flat surface. The determination of the total number of passes ($N=N_1+N_2$) and the distribution of passes along axes ($T_1$) and ($T_2$) are essential to the production of the desired structure, texture and properties of the worked material. The ratio of passes along each axis ($N_1/N_2$) defines the anisotropy direction angle ($\phi$) (see FIG. 8C). Because the cumulative simple shear is a vector sum of the shear along axes ($T_1$) and ($T_2$), which is proportional to the number of passes ($N_1$) and ($N_2$), the direction of cumulative shear deformation ($\phi$) and the number of passes along the longitudinal axes are described by the following equations:

$$N_1 = \frac{N}{1 + \tan\phi}$$

$$N_2 = \frac{N\tan\phi}{1 + \tan\phi}$$

where:

N is the established total number of passes; $\phi$ is the angle between the first longitudinal axis ($T_1$) and the direction of grain elongation or axis of anisotropy at the flat surface of the billet.

Figure 9:
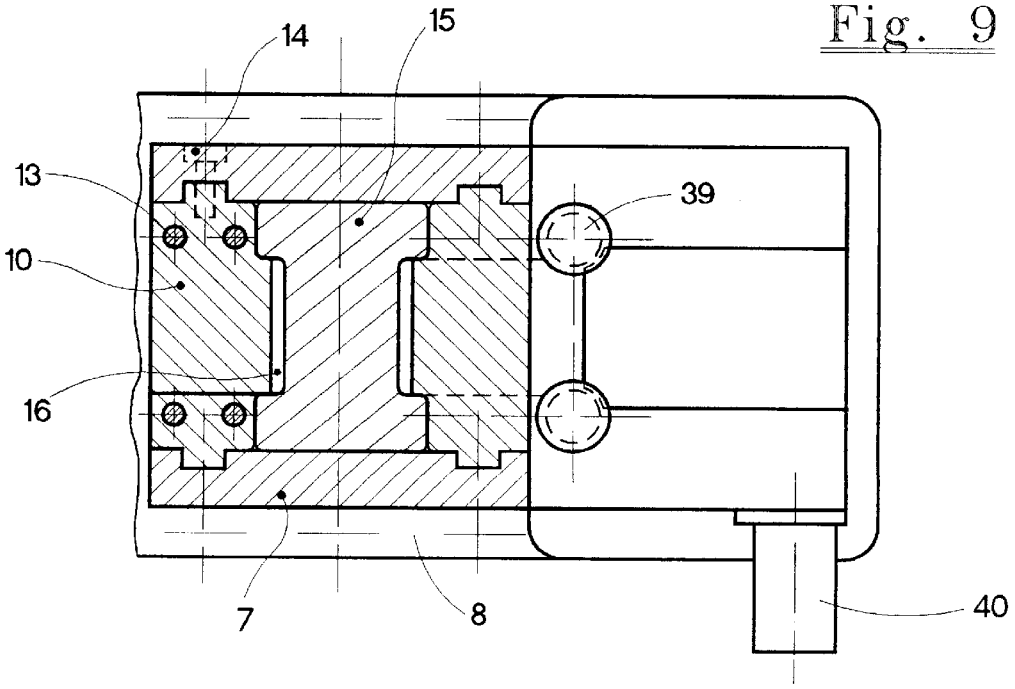
FIG. 9 is a micrograph (50×) showing the microstructures at the flat surface of a copper billet which has undergone rolling-like plastic deformation processing.

In this method all material structural elements such as grains, phases, separations and others are strictly oriented and elongated in the direction of cumulative shear deformation. The aspect-ratio of these elements is significantly increased in proportion to the total number of passes (N). Therefore, similar to rolling, the direction of cumulative shear defines the orientation of texture and anisotropy in the worked materials. These features are depicted in FIG. 9 which shows the microstructure at the flat surface of a heavily worked ($N_1=N_2=2$) copper billet. Equal channel angular extrusion also may be performed along only one of the longitudinal directions ($T_1$) or ($T_2$) with a number of passes ($N_1$) or ($N_2$). As a result, the structural and textural effects described above may be developed along the first ($T_1$, $\phi=0$) or the second ($T_2$, $\phi=90°$) longitudinal directions.

Figure 12:
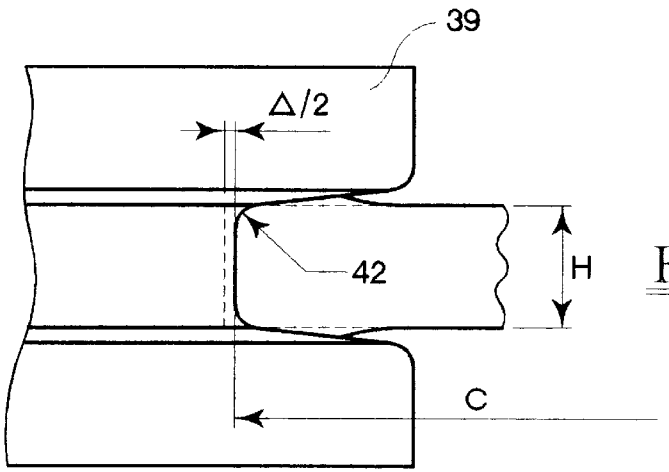
FIG. 12 is a micrograph (50×) showing the microstructures at the flat surface of a copper billet which has undergone plastic deformation processing to produce textureless material having wrought equiform structures.
Figure 10:
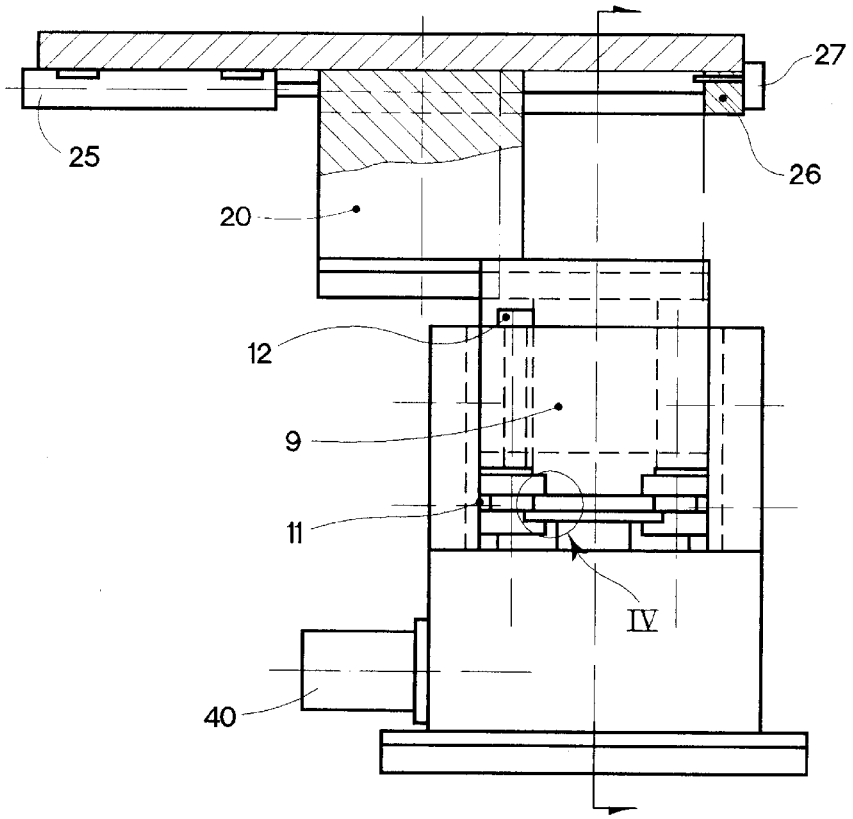
FIGS. 10A–D show a method of plastic deformation processing to produce textureless material having wrought equiform structures.
Figure 11:
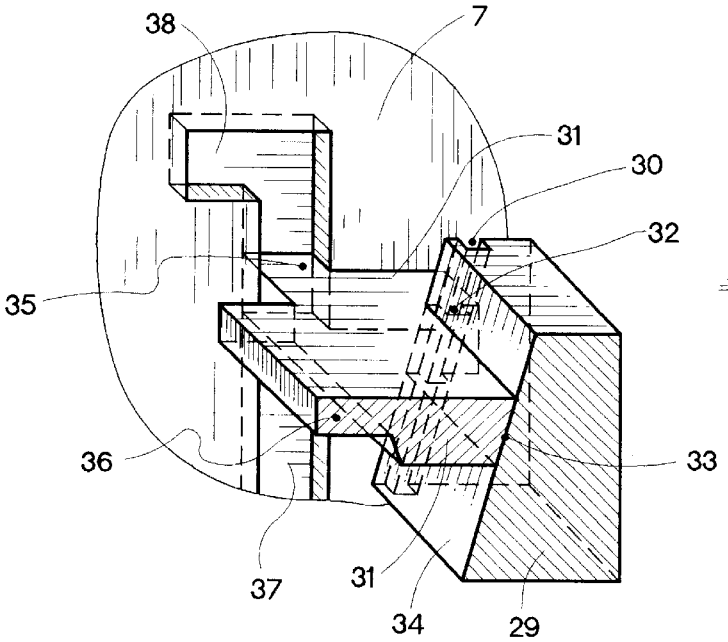
FIGS. 11A–D show the distortion of structural elements during plastic deformation processing to produce textureless material having wrought equiform structures.

The method also includes the periodic alteration of extrusion direction (V) by rotating the billet 90° in the same direction about the perpendicular axis (n) following each extrusion (see FIG. 10). In this manner, simple shear is produced along axis $T_1$ in the opposite directions at passes N=1 and N=3 (see FIGS. 10A and 10C). Similarly, simple shear is produced along axis $T_2$ in the opposite directions at passes N=2 and N=4 (see FIGS. 10B and 10D). Following passes N=1 and N=2 the material structural elements are destroyed along axes $T_1$ and $T_2$, respectively (see FIGS. 11A and 11B). These material structural elements are subsequently restored after passes N=3 and N=4 (see FIGS. 11C and 11D). Therefore, following a number of passes divisible by four heavily wrought but equiform and equiaxial structures without preferable texture and anisotropy are produced in flat billets. FIG. 12 depicts the microstructure at the flat surface of a copper billet following four passes utilizing the above described procedure.

The method also includes performing multipass equal channel angular extrusion along the same longitudinal axis ($T_1$) with periodic changes in the extrusion direction (V) accomplished by rotating the billet 180° about the normal axis (n) to the flat surface of the billet following each extrusion (see FIG. 13). Material structural elements are destroyed following each odd numbered extrusion and restored following each even numbered extrusion. At the same time, the rotation of grains and subgrains and the rearrangement of their crystallographic planes and directions of easy sliding along the shear plane and shear directions is promoted by the conservation of shear plane and shear direction. This method produces heavily wrought equiform and equiaxial structures with full textures under angle (Θ) to the flat surface of the billet following each even numbered extrusion.

The method also includes combining equal channel angular extrusion with post-extrusion deformation. Post-extrusion deformation is performed along either or both of the longitudinal axes by traditional forming operations such as rolling or forging (see FIGS. 14A–D). This method produces heavily wrought flat products of small thickness and large width and/or length which demonstrate controlled texture and anisotropy in the prescribed directions. Because initial billet dimensions and the desired final product dimensions are known, the reductions $\epsilon_1$ and $\epsilon_2$ of post-extrusion deformation along longitudinal axes $T_1$, and $T_2$ may be calculated (see FIGS. 14C and 14D). Therefore, the number and direction of extrusions to be used during preliminary processing by equal channel angular extrusion to achieve the desired structure and properties in the final product can be precisely determined.

A predetermined number of extrusions ($N_1$, $N_2$) are performed prior to rolling or forging along each longitudinal axis. Alteration of extrusion direction (V) is accomplished by rotating the billet 90° clockwise and counter-clockwise in any desired sequence about the normal axis (n) of the billet (FIG. 14A and 14B). By accounting for the additional reductions $\epsilon_1$ and $\epsilon_2$ and the total number of extrusion ($N=N_1+N_2$) required to produce the desired properties in the worked material, the number of extrusions along longitudinal axes $T_1$ and $T_2$ required to develop the desired orientation of anisotropy under angle $\phi$ at the flat surface of the billet can be calculated from the following equations:

$$N_1 = \frac{N\epsilon_2}{\epsilon 2 + \epsilon_1 \tan\phi}$$

$$N_2 = \frac{N\epsilon_1 \tan\phi}{\epsilon 2 + \epsilon_1 \tan\phi}$$

where:

N is the established total number of extrusions ($N=N_1+N_2$); $\phi$ is the angle between the direction of anisotropy and the first longitudinal axis ($T_1$); $\epsilon_1$ is the area reduction during the additional deformation along axis ($T_1$) which is necessary to reach the final product length; and $\epsilon_2$ is the area reduction during additional deformation along axis ($T_2$) which is necessary to reach the final product width.

Additional deformation is first performed along longitudinal axis $T_2$ with reduction ($\epsilon_2=A/h_1=B/c$) to increase the billet width from c to B (see FIG. 14C). Additional deformation is then performed along longitudinal axis $T_1$ with reduction ($\epsilon_1=h_1/h=L/b$) to increase the billet length from b to L (see FIG. 14D). Following this process, $\epsilon_1>\epsilon_2$.

Another embodiment of the method comprises preliminary equal channel angular extrusion performed only along the axis ($T_1$) of the larger reduction ($\epsilon_1$) which will be produced by post-extrusion rolling or forging. The number of extrusions ($N_1$) must be sufficient to develop the desired structural affects and to increase grain aspect ratio, texture and anisotropy along this axis ($T_1$) (see FIGS. 14A, 14C, and 14D).

A further embodiment of this method comprises preliminary equal channel angular extrusion performed only along the longitudinal axis ($T_2$) of smaller reduction ($\epsilon_2$) which will be produced by post-extrusion rolling or forging (see FIGS. 14B, 14C and 14D).

Depending on reductions ($\epsilon_1$) and ($\epsilon_2$), an increase in the number of passes ($N_2$) may result in the following progressive effects. Initially, it results in a decrease of the grain aspect ratio, texture and anisotropy which is induced by the forming operation along the first longitudinal direction ($T_1$). Subsequently, the forming operation along the first longitudinal direction ($T_1$ ) is fully compensated by production of equiform grains and textureless materials. Finally, grain elongation, texture and anisotropy is developed along the second longitudinal direction ($T_2$). Therefore, the number of extrusions ($N_2$) must be sufficient to realize any of these effects.

Equal channel angular extrusion overcomes the many disadvantages associated with prior methods of intensive plastic deformation materials. In addition to the known benefits of equal channel angular extrusion of elongated billets, the present invention provides further important technical advantages for flat billets. For example, the die of the present invention provides the ability to simultaneously extrude two billets. The simultaneous extrusion of two billets eliminates friction between the stationary and movable die parts, reduces the dimensions of the die, and increases significantly die lifetime and stability.

The method of the invention provides special systems of billet orientation between subsequent passes to develop strictly oriented structures and textures along the prescribed direction at the billet flat surface as well as equiaxial structure and textureless materials. Another embodiment of the method provides means to develop similar structures and textures in thin products of large width and large length by combining equal channel angular extrusion with post-extrusion processing by forming operations (rolling, forging, etc.) along either or both longitudinal axes.

The movable slider and punch design optimize press space and stroke in the deformation processing of large billets. The automatic and independent ejection system of the present die allows for deformation processing at standard presses, which do not normally provide for billet ejection in a direction perpendicular to the press stroke. Moreover, rolling billets following ejection permits multi-pass processing by equal channel angular extrusion without the necessity of intermediate billet working, machining, or heating.

The extrusion method and apparatus of the present invention provide the ability to process massive flat billets and thus to produce bulk flat products of large width and length which have controlled structure, texture, and physicomechnical properties oriented in any desired direction at the billet flat surface. In addition, the extrusion method and apparatus may be used with a wide variety of materials including, but not limited to, pure metals, alloys, composites, ceramics and the like. Moreover, the method may be performed and the apparatus may be used at cold, warm or hot temperatures.

What is claimed is:

1. A method of intensive plastic deformation of flat billets having large ratios of billet dimensions along longitudinal axes to a billet thickness, comprising the steps of inserting a billet into a vertical channel whose length corresponds to a billet dimension along a first longitudinal axis while a width corresponds to a billet dimension along a second longitudinal axis, and a thickness corresponds to a billet thickness; extruding the billet along the first longitudinal axis from the vertical channel into a horizontal channel which is contiguous with and oriented at an angle to the vertical channel; ejecting of the billet along an axis of horizontal channel after completing the extruding; repeating the steps of inserting, extruding and ejecting of the billet along the first longitudinal axis; rotating the billet 90 degrees about a perpendicular axis to a fixed flat surface of the billet; inserting the billet into an another vertical channel whose length corresponds to the billet dimension along the second longitudinal axis while a width corresponds to the billet dimension along the first longitudinal axis, and a thickness corresponds to the billet thickness; extruding the billet along the second longitudinal axis from the another vertical channel into a corresponding another horizontal channel having the same cross-section, and being contiguous with and oriented at an angle to the another vertical channel; ejecting of the billet along an axis of the another horizontal channel after completing the extruding; repeating the steps of inserting, extruding and ejecting of the billet along the second longitudinal axis; rotating the billet 90 degrees in the direction opposed to the first-mentioned rotating about the perpendicular axis to the fixed flat surface of the billet; performing a number of the extruding steps along the first and second longitudinal axis of the billet in any sequence in accordance with equations:

$$N_1 = \frac{N}{1 + \tan\phi},$$

$$N_2 = \frac{N\tan\phi}{1 + \tan\phi}$$

where N is an established total number of extruding steps; $N_1$ is a number of extruding steps along the first longitudinal axis; $N_2$ is a number of extruding steps along the second longitudinal axis; $\phi$ is an angle between the first longitudinal axis and a direction of anisotropy at the billet flat surface.

2. A method as defined in claim 1; and further comprising rotating the billet 90 degrees in the same direction about the perpendicular axis to the fixed flat surface of the billet following each step of successively extruding along both longitudinal axes; repeating the steps of extruding along both longitudinal axes with a total number of extruding steps divisible by four.

3. A method as defined in claim 1; and further comprising the steps of plastically deforming the billet after completing the steps of extruding along one longitudinal axis by reducing the billet thickness and increasing the billet length along said one longitudinal axis to a dimension corresponding to a width of a final flat product; plastically deforming the billet along another longitudinal axis by further reducing the billet thickness and increasing the billet length along the another longitudinal axis to a length of the final product; performing a number of steps of preliminary extruding along the first and second longitudinal axis of the original billet in accordance with equations:

$$N_1 = \frac{N\epsilon_2}{\epsilon 2 + \epsilon_1\tan\phi}$$

-continued $$N_2 = \frac{N\epsilon_1\tan\phi}{\epsilon 2 + \epsilon_1\tan\phi}$$

where N is an established total number of extruding steps; $N_1$ is a number of extruding steps performed along the longitudinal axis of the billet corresponding to the length of the final product; $N_2$ is a number of extruding steps performed along the longitudinal axis of the billet corresponding to the width of the final product; $\epsilon_1$ is an area reduction resulting from a post-extrusion deformation which is necessary to reach the final product length; $\epsilon_2$ is an area reduction resulting from a post-extrusion deformation which is necessary to reach the final product width; $\phi$ is an angle between a direction of the billet length and a direction of anisotropy at the billet flat surface.

4. An apparatus for intensive plastic deformation of flat billets, comprising: a first and a second vertical channel of identical cross-section one wall of which is defined by front plates secured to a die assembly, and three other walls are defined by two longitudinal cavities formed symmetrically on opposite sides of a rectangular slider disposed between said front plates and side plates; a first and a second horizontal channel directed oppositely, having a cross-section corresponding to the cross-section of the vertical channels, and being contiguous with and oriented at an angle relative to the first and second vertical channels respectively, formed between front plates and two rest plates fixed to the die assembly, and provided with protrusions; a punch assembly connected to the slider and covering both vertical channels to extrude simultaneously two billets from each vertical channel into the corresponding horizontal channel; an ejector system including a two-sided wedge with inclined slots attached by a narrow end to a bottom of the movable slider, and two pushers having inclined surfaces contacting to the inclined face of one side of the wedge respectively, provided with ejectors cooperating to the corresponding horizontal channel, shoulders cooperating with inclined slots of the wedge, and guide projections sliding into contiguous vertical and horizontal slots of side plates along an axis of the corresponding horizontal channel and into the vertical direction; two couples of vertical rolls located at a midpoint level of the horizontal channels at a distance providing billet rolling after completing a step of ejection, driven into an extrusion direction with a peripheral speed equal to an extrusion speed, and having semiclosed passes to form radii along billet edges and locally reduce a billet width of about 1% of an original width.

* * * * *